US011266559B2

(12) United States Patent
Bush

(10) Patent No.: US 11,266,559 B2
(45) Date of Patent: Mar. 8, 2022

(54) METHODS AND APPARATUS FOR HANDLING CREMATION ASHES

(71) Applicant: Tributes Ltd., Poling (GB)

(72) Inventor: Richard Bush, Poling (GB)

(73) Assignee: Tributes Ltd., Poling (GB)

( * ) Notice: Subject to any disclaimer, the term of this patent is extended or adjusted under 35 U.S.C. 154(b) by 87 days.

(21) Appl. No.: 16/848,728

(22) Filed: Apr. 14, 2020

(65) Prior Publication Data

US 2020/0323723 A1 Oct. 15, 2020

(30) Foreign Application Priority Data

Apr. 15, 2019 (EP) ..... 19169168

(51) Int. Cl.
*A61G 17/08* (2006.01)
*F23J 1/02* (2006.01)
*F23G 1/00* (2006.01)

(52) U.S. Cl.
CPC ..... *A61G 17/08* (2013.01); *F23J 1/02* (2013.01); *F23G 1/00* (2013.01)

(58) Field of Classification Search
CPC .. A61G 17/08; A61G 17/007; A61G 17/0073; A61G 17/00; E04H 13/008;
(Continued)

(56) References Cited

U.S. PATENT DOCUMENTS 4,868,949 A * 9/1989 Loveless ..... A47L 7/0071 15/352
5,636,418 A * 6/1997 Vail, III ..... A61G 17/08 27/1

(Continued)

FOREIGN PATENT DOCUMENTS

JP 2008007200 A 1/2008
KR 20030001050 A 1/2003

OTHER PUBLICATIONS

EPO, Rule 62 EPC Search Report and Search Opinion of EP Patent Application Serial No. 19169168.2 (dated Oct. 2, 2019).

*Primary Examiner* — William L Miller
(74) *Attorney, Agent, or Firm* — UltimatEdge IP Law Group, P.C.; Dean G. Stathakis

(57) ABSTRACT

A crematorium ashes transfer container made of paper and/or cardboard comprises:

one or more sides and/or walls defining a cavity to receive the ashes;

an outlet in one of the sides and/or walls allowing exit of ashes in the cavity from the container, the outlet comprising a nozzle and a removeable cap that closes the nozzle, the nozzle being capable of sealing engagement with a long term storage container, whereby ashes within the cavity of the container can be transferred to the long term storage container without being visible during transfer and without leakage of ashes during transfer.

A method of transferring cremation ashes into a long term ashes storage container, comprises:— a. providing ashes from a cremation, b. providing a long term ashes storage container having an inlet and providing a crematorium ashes transfer container made of paper and/or cardboard that comprises a nozzle capable of sealing engagement with the inlet on the long term storage container, c. transferring the ashes into the crematorium ashes transfer container, d. sealing the crematorium ashes transfer container, e. opening the nozzle, f. connecting the nozzle with the inlet of the long term storage container so as to be in sealing engagement therewith, and (Continued)

g. transferring the ashes into the long term storage container.

A kit comprises the transfer container and the long term storage container.

14 Claims, 4 Drawing Sheets

(58) Field of Classification Search
CPC . F23J 1/02; F23J 1/00; F23J 2700/001; F23G 1/00
USPC ..... 27/1; 110/165 R, 171, 194
See application file for complete search history.

(56) References Cited

U.S. PATENT DOCUMENTS

| | | | | |
|---|---|---|---|---|
| 6,041,483 | A * | 3/2000 | Burch | A61G 17/08 27/1 |
| 7,178,209 | B1 | 2/2007 | Radziewicz | |
| 2003/0046798 | A1* | 3/2003 | Valles Camps | A61G 17/08 27/1 |
| 2007/0084027 | A1 | 4/2007 | Walczak | |
| 2011/0005048 | A1 | 1/2011 | Davis et al. | |
| 2011/0089605 | A1* | 4/2011 | Olcina | A61G 17/007 264/241 |
| 2014/0215933 | A1 | 8/2014 | Carlson et al. | |

* cited by examiner

METHODS AND APPARATUS FOR HANDLING CREMATION ASHES

CROSS-REFERENCE

This application claims the benefit of priority and the filing date pursuant to 35 U.S.C. § 119(a) to European Patent Application Serial No. 19169168.2, filed on Apr. 15, 2019, the content of which is hereby incorporated by reference in its entirety.

INTRODUCTION

The present invention relates to handling of ashes from cremations, of animals including pets, and humans. In particular, the present invention relates to methods of handling such ashes and transferring ashes into long term storage containers, such as urns, to kits for handling of ashes and to cremation ashes transfer containers.

BACKGROUND TO THE INVENTION

Cremation is nowadays a common option for deceased family members and also animals such as pets. Cremation generates ashes and, naturally, the handling and storage of these ashes is a sensitive issue from several respects: friend and relatives and family may wish to disperse ashes in a particular way such as by scattering at a location special to the deceased or may wish to keep ashes as a momento, for example in an urn; handling of ashes by individuals and also by cremation professionals must comply with various health and safety regulations.

Post cremation, ashes can be placed directly into an urn, which may be conventionally formed and often designed as an attractive/discreet ornament for a sideboard or similar. Urns are known in a wide range of shapes and sizes and can also have compartments for other items reminiscent of the departed, such as a photograph, a lock of hair, and also in the case of a pet an item such as a collar, nametag or lead.

Once in an urn, ashes generally stay there forever. Placing ashes into such an end-of-use storage container shortly after cremation is uncomplicated, as this is done by crematorium professionals following careful procedures. But to do so requires a decision by friends or relatives prior to cremation. Decisions of this nature at a time so close to the date of death can be difficult to make. Another option, as an alternative to having ashes permanently in an urn or similar is for ashes to be scattered. Hence, ashes may be placed into a so-called scatter tube; again this is done shortly after cremation and at the crematorium. These scatter tubes are of very common design, made of paper/cardboard and are one-use only and designed for temporary storage of ashes and for relatives, family, etc to have possession of ashes in order for subsequent release of ashes via scattering at the right time and place.

One problem with the above-described handling of ashes is in cases where a choice between placing ashes into an urn or into a scatter tube is not taken by the time of cremation; the result is ashes that need to be stored at the crematorium until such a decision is indeed taken. As will be appreciated, in the absence of a decision ashes can then remain in the crematorium storage facility for an extended period. It is a known problem for crematorium operators that they are forced to retain and store large quantities of ashes for extended periods often with little hope of resolution of a permanent future for the ashes. Alternatively, ashes are placed into a scatter tube but then not scattered, and remain in the scatter tube though this is not designed for permanent storage and is primarily designed for scattering of ashes.

A range of specific scatter tubes are available, being tubes of circular or rectangular cross section. These are designed for and used for fundamentally a single purpose, namely the scattering of ashes. The tubes are not designed for accurate pouring and ashes exiting the scatter tube are visible and exposed; fine ash can be blown in different directions by wind, which of course is a component of the scattering process but on the other hand ash being poured can be inhaled by those nearby. Some scatter tubes have a pre-perforated disc that can be pushed or punched through to open the scatter tube. The resultant flap can prevent some ash exiting the tube. Also, tube interior dimensions and layout can separately mean that the tube is not fully emptied of ash during scattering. Lastly, scatter tubes are supplied with parts that are unglued and can be separated so that they can be filled with ashes then assembled and glued together.

One example of a known urn is in US 2007/0084027 being a burial urn with a top-loaded lid and no hole or plug on its bottom surface. Another burial urn, this time with a T shaped sealing plug is known from KR 2003/0001050. Another cremated remains burial system is known from US 2014/0215933, made up of an urn, an urn lid, an urn enclosure and a head stone. From U.S. Pat. No. 7,178,209 a metal urn is known with attachments so that the urn can be attached to e.g. a motor bike. JP 2008/007200 discloses a female-female plastic container for connecting PET bottles via screw threads. Lastly, a cremation urn having a base and a lid is also known from US 2011/0005048.

None of the disclosures appreciate the problems of ashes being stored in absence of a decision as to whether ashes should be scattered or transferred to a permanent urn. Also, the urns disclosed are made of permanent materials such as china or metal.

Thus there exists a need for alternative and preferably improved methods and apparatus for handling of cremation ashes. In particular there is a need, newly identified by the inventors, for means to store ashes away from a cremation facility while retaining various options for downstream handling of the ashes while meeting health and safety procedures and accommodating the sensitivities around handling ashes of loved ones.

SUMMARY OF THE INVENTION

Accordingly, the present invention provides a crematorium ashes transfer container, comprising:

one or more sides and/or walls defining a cavity to receive the ashes;

an outlet in one of the sides and/or walls allowing exit of ashes in the cavity from the container, the outlet comprising a nozzle and a removeable cap that closes the nozzle, the nozzle being capable of sealing engagement with a long term storage container, whereby when in said sealing engagement ashes within the cavity of the container can be transferred to the long term storage container without being visible during transfer and without leakage of ashes during transfer.

The transfer container can hence be suitable for and used for scattering ashes or for transferring ashes into another vessel, e.g. a long term storage container. It may also be useful for storage of ashes from a crematorium and for subsequent uses as described.

A method of transferring cremation ashes into a long term ashes storage container is also provided by the invention, the method comprising:— a. providing ashes from a cremation, b. providing a long term ashes storage container having an inlet and providing a crematorium ashes transfer container that comprises a nozzle capable of sealing engagement with the inlet on the long term storage container, c. transferring the ashes into the crematorium ashes transfer container via the nozzle, d. sealing the crematorium ashes transfer container with the ashes inside, e. opening the nozzle, f. connecting the nozzle with the inlet of the long term storage container so as to be in sealing engagement therewith, and g. transferring the ashes into the long term storage container.

The invention further provides a kit comprising the crematorium ashes transfer container and a sealable, long term ashes storage container comprising a cavity and an inlet for transfer of ashes into the cavity, wherein the nozzle on the transfer container can sealingly engage with the inlet on the storage container.

Options for handling of ashes are thereby provided by the invention, as is a new product for ashes handling.

Details of the Invention

In more detail, a method of transferring cremation ashes into a long term ashes storage container is provided by the invention, the method comprising:— a. providing ashes from a cremation, b. providing (i) a long term ashes storage container having an inlet and (ii) a crematorium ashes transfer container that comprises a nozzle capable of sealing engagement with the inlet on the long term storage container, c. transferring the ashes into the crematorium ashes transfer container via the nozzle, d. sealing the crematorium ashes transfer container with the ashes inside, e. opening the nozzle, f. connecting the nozzle with the inlet of the long term storage container so as to be in sealing engagement therewith, and g. transferring the ashes into the long term storage container.

A preferred feature is that the method can comprise transferring the ashes into the long term storage container without the ashes being visible; this avoids sensitivities connected with sight of the ashes by friends and relatives. A separate and also preferred feature is that the method can comprise transferring the ashes into the long term storage container without the ashes leaking during transfer. Sealing the transfer container to the storage container achieves this and hence conveniently enables handling and transfer of ashes while complying with relevant health and safety regulations even if outside the controlled environment of the crematorium facility. Leaking of ashes is also messy and can now be avoided.

In use, after a cremation, the ashes are transferred into or otherwise filled into the transfer container. Generally this takes place soon after cremation and at the crematorium; it is a job usually for crematorium or funeral director (also known as undertakers or morticians) professionals. The container is then sealed, e.g. by closing the nozzle. In this closed position the container can be given e.g. to friends/relatives. The container can subsequently be opened and used for scattering. It can be used for temporary storage of ashes away from the crematorium and away from the storage facilities of the funeral directors. Ashes can subsequently, after a brief or longer intervening period, be transferred into long term storage; transfer is usually by partially or fully inverting the transfer container assisted by some shaking until all ash is transferred.

The nozzle suitably has a screw thread and the long term storage container inlet also suitably has a screw thread and the method comprises screwing the nozzle into or onto the inlet so as to form a seal therewith prior to transferring the ashes.

As an alternative, the nozzle and inlet may have other mutually sealing fittings, for example they may comprise sealing bayonet fittings and the method may comprise attaching the nozzle into or onto the inlet and twisting one relative to the other so as to form a seal therewith prior to transferring the ashes.

The method generally comprises sealing the long term storage container after transferring the ashes, e.g. using a cap or bung or the like. The storage container is thus ready for use, e.g. display at home.

A difficulty with known scatter tubes is a small portion of ash remaining inside. It is preferred that the crematorium ashes transfer container has an interior profile such that once opened there are no interior nooks or crannies or crevices that can trap ash and prevent complete emptying of ash from the container during transfer, and wherein the method comprises continuing transferring the ashes until there are substantially no ashes remaining in the crematorium ashes transfer container.

The crematorium ashes transfer container itself is part of the invention, and the method preferably uses a transfer container as defined in more detail below and in the examples.

Further provided by the invention is a kit comprising (i) a crematorium ashes transfer container as defined herein, and (ii) a sealable, long term ashes storage container comprising a cavity and an inlet for transfer of ashes into the cavity, wherein the nozzle on the transfer container can sealingly engage with the inlet on the storage container.

Users can thus be provided with two components in a kit: a first to receive ashes post cremation and which can be used for various functions, including temporary storage of ashes, scattering of ashes if such is desired or subsequent transfer of ashes into a long term storage container; and a second which is the long term storage device and often the ultimate destination of the ashes. If ashes are scattered from the transfer container then the long term storage container is not used. If some of the ashes are scattered then the remainder can be transferred into the long term storage container.

As described herein and in examples below, transfer of ashes is achievable without sight of ashes and without spillage. Accordingly, the transfer container may comprise a nozzle that seals to a corresponding fitting on a long term ashes storage container. As one example, the nozzle has a screw thread and is sealable with its own screw cap; this nozzle is for use with a long term storage container having an inlet with a screw threaded fitting. As another, the nozzle may have a bayonet fitting sealable with a corresponding cap; this is for use with a long term storage container having an inlet with a corresponding fitting to receive and seal with the bayonet fitting of the nozzle.

For ease of transfer, it is preferred that the transfer container outlet screws into the storage container inlet to form a seal that prevents ash leaking during transfer of ashes between the containers.

Various options exist for the storage container, in lie with options available now and in the future. Just as representative examples the storage container may be an urn or in the form of a human or animal or even a facsimile of a human or animal or part thereof; in particular the storage container can be a facsimile of or in the form of a domestic pet such as a cat, dog, rodent or reptile, or part thereof.

Another kit is provided by the invention, comprising (i) a crematorium ashes transfer container according to the invention, and (ii) a nozzle extension having a distal end and a proximal end, wherein the nozzle on the transfer container can sealingly engage with the proximal end of the nozzle extension.

The nozzle extension facilitates transfer of ashes out of the transfer container into another container, e.g. a long term storage container, that in contrast to specifically adapted storage containers does not seal directly to the nozzle. The extension does seal to the nozzle and reduces the risk of spillage when transferring ashes into such non-adapted end containers and also provides a shield to try to keep ashes invisible as far as possible during such transfer. The extension may thus bridge the gap between the transfer container and the end container, enabling transfer out of sight and with reduced and preferably no spillage.

As mentioned, the nozzle preferably seals to a corresponding fitting on the nozzle extension. As one example, the nozzle has a screw thread and is for use with a nozzle extension having a screw threaded fitting at its proximal end. As another, the nozzle may have a bayonet fitting sealable with a corresponding fitting at the proximal end of the extension.

The transfer container outlet preferably screws into the proximal end of the nozzle extension to form a seal that prevents ash leaking during transfer of ashes out of the transfer container.

The nozzle extension is preferably in the form of an elongated tube, approximately circular in cross section. At its proximal end, as noted, it fits onto the transfer container nozzle. At its distal end it may simply be open ended. Alternatively, it may comprise a narrowed nozzle of its own. It may comprise its own removeable, sealing cap.

A crematorium ashes transfer container per se is additionally provided by the invention, for storage of ashes from a crematorium and for subsequent transfer of ashes into a separate, long term storage container, wherein the transfer container comprises:

one or more sides and/or walls defining a cavity to receive the ashes;

an outlet in one of the sides and/or walls allowing exit of ashes in the cavity from the container, the outlet comprising a nozzle and a removeable cap that closes the nozzle, the nozzle being capable of sealing engagement with the long term storage container, whereby when in said sealing engagement ashes within the cavity of the container can be transferred to the long term storage container without being visible during transfer and without leakage of ashes during transfer.

Generally, the transfer container comprises an end wall at the top, an end wall at the bottom and one or more sides; the container may be in the form of a circular tube, being approximately cylindrical in which case there is one continuous side with circular cross-section and circular top and bottom end walls. An approximately tubular form can also be provided by one or more sides and/or walls. These containers of the invention may be referred to as transfer tubes. Preferred tubes are circular in cross-section.

Transfer containers of the invention may be designed so that the nozzle can be hidden from sight by an outer cap, giving an improved aesthetic to the container. Examples are shown below. More generally, the crematorium ashes transfer container may be such that the outlet is located on an upper surface, e.g. top end wall, of the container, a region of the one or more sides and/or walls around the circumference of the container at the top of the container is slightly reduced in circumference compared with the circumference of the side wall below that region, and wherein the container further comprises an outer cap in the form of an open ended sheath that is of similar cross section to the side wall below that region and fits around the region of reduced circumference so as to obscure the outlet and its cap.

In use the transfer container is filled and the nozzle closed, and then the outer cap is fitted. Conveniently, when the outer cap is fitted to the container, the container with the outer cap has the appearance of single tube. The outer cap can be slid off to reveal with nozzle and its cap when needed.

Various shapes and sizes for the transfer container may be adopted. The container may be substantially circular in cross section. It may be substantially rectangular in cross section. It may also be substantially square in cross section. All such designs may be described as transfer tubes, especially if they have vertical dimensions in excess of their horizontal dimensions, i.e. are taller than they are wide, and sit upright on a flat surface, as is the case for specific embodiments described in more detail in examples below.

An additional option for embodiments of the invention is that the transfer container can be buried. Accordingly, the crematorium ashes transfer container may be made entirely of biodegradable components (or comprise non-biodegradable components all of which are readily removed from the exterior, an outer wrapping for example). It is then suitable to be buried. Sides and/or walls and/or end walls may be made of paper and/or cardboard. The nozzle and its cap maybe made of starch-based materials or other material that biodegrade. It is further preferred that the transfer containers are made of such materials and sealable so as to be accepted for use on board aircraft.

The capacity of the transfer tube is in line with known scatter tubes. The transfer tube generally comprises an internal cavity, with access via the nozzle. Sides and/or walls are generally fairly thin, especially if made from paper/cardboard. The volume of the cavity may be up to 10 liters, being suitable to accommodate the anticipated volume of ash from cremation of a large human, more suitably up to 5 liters or up to 4 liters (calculated as sufficient for cremation of an adult human of up to 105 Kg). Particular containers may be adapted for the volumes expected from smaller human cremation or cremation of animals of various sizes.

Accordingly, dimensions of the transfer tubes may vary. In particular examples tubes are of height up to 50 cm, more suitably up to 40 cm. Tubes may be approximately up to 20 cm wide, more suitably up to 15 cm wide. Specific examples of tubes are approximately 37 cm high and 13 cm wide, and preferably round in cross section.

Further specific examples are approximately 25 cm high and 11 cm wide, and preferably round in cross section. Still further specific examples are approximately 9 cm high and 3.5 cm wide, and preferably round in cross section.

A further problem identified with known scatter tubes is that ash may be trapped inside. In preferred embodiments of the invention, the crematorium ashes transfer container comprises a cavity having an interior profile such that once opened there are no interior nooks or crannies or crevices that can trap ash and prevent complete emptying of ash from the container during transfer.

Sight of ashes during transfer into and out of the transfer container is preferably avoided. The container nozzle is preferably opaque.

As described herein and in examples below, transfer of ashes is preferably without sight of ashes and without spillage. Accordingly, the transfer container may comprise a nozzle that seals to a corresponding fitting on a long term ashes storage container. As one example, the nozzle has a screw thread and is sealable with its own screw cap; this nozzle is for use with a long term storage container having an inlet with a screw threaded fitting. As another, the nozzle may have a bayonet fitting sealable with a corresponding cap; this is for use with a long term storage container having an inlet with a corresponding fitting to receive and seal with the bayonet fitting of the nozzle.

Yet further provided by the invention is a method of handling ashes comprising:

a. providing ashes from a cremation, b. providing a crematorium ashes transfer container that comprises a sealable nozzle capable of sealing engagement with an inlet on a long term storage container, c. transferring the ashes into the crematorium ashes transfer container via the nozzle, and d. sealing the crematorium ashes transfer container with the ashes inside.

In optional and preferred embodiments of the handling method, the crematorium ashes transfer container is as defined elsewhere herein.

In preferred embodiments of the invention, the transfer container is made of paper and/or cardboard and the nozzle and cap are made of biodegradable material.

Nozzles and caps have been successfully made and used made of a corn-starch based polymer, and other biodegradable materials for the nozzle and cap are known and suitable.

Transfer containers may be surrounded by a plastic film that is decorated or which protects decoration provided on the outside of the container. The film can be removed prior to burial. The film may also be biodegradable.

Referring to the methods and kits and containers of the invention, a first advantage of the transfer tubes herein is they represent a hitherto unknown product with hence new properties and uses; the art does not provide a transfer tube. A further advantage is the transfer tubes are easier to make and fill than known scatter tubes. For the latter, generally an open-ended tube with hence a wide opening is filled from above with ashes and then a closing tube end is pushed onto the open end and glued in position, thus forming the filled, closed scatter tube. The closing tube has an air escape hole to allow exit of air while the respective ends are be closed and sealed; that escape hole is then sealed after forming the closed tube. The glue can easily be put onto the wrong place, meaning the respective ends do not bond or that a lid (like the outer cap of the transfer tube), which is intended to be removeable and is added in a later step, is accidentally glued fast in position. For specific transfer tubes of the invention, there is no need for a two-part tube construction, and no glue is required to bond the two parts together when assembling—it is assembled prior to filling with ashes, and indeed filling is generally via the nozzle, for example using a funnel. For the transfer tubes of the invention there is no need for an air escape hole as seen on the bottom of the known scatter tubes; note that, after use to allow air to escape, a sticker has to be put over this hole to seal it to prevent escape of ash dust. Hence, a further preferred feature of the transfer container of the invention is that its parts are provided as an integral whole, whereby access to the cavity is only via the nozzle. Thus, unless it is pierced or cut into, or its integrity otherwise compromised, the container can only be filled via the nozzle. This is in contrast to known scatter tubes, in which the tubes are in 2 parts that can be slid apart, for the tube to be filled with ashes and then re-assembled, sealed and glued.

Transfer tubes of the invention can, of course, be used for scattering if desired, and can also be used for transfer of ashes into other containers as described. Their replaceable cap is easier to open and close without leak of ashes. They can be conveniently filled via the closeable nozzle. In embodiments, the transfer tube is fully biodegradable and can be buried. Preferably, the tube is made of paper and/or cardboard; more preferably, all of the tube apart from the nozzle is paper and/or cardboard. The openings of scatter tubes generally are one-use only and their interior shape and/or the push-in tab prevent complete emptying of ashes, whereas in the present invention the transfer tube opening and interior geometry can all contribute to enabling complete emptying of ashes from the cavity.

EXAMPLE

The present invention is now described in more and specific details with reference to the accompanying drawings in which:

FIGS. 1*a-c* shows (1*a*) a side view of a transfer tube of the invention, (1*b*) a view from below of the transfer tube and (1*c*) a view from above of the transfer tube;

Figure 1C:
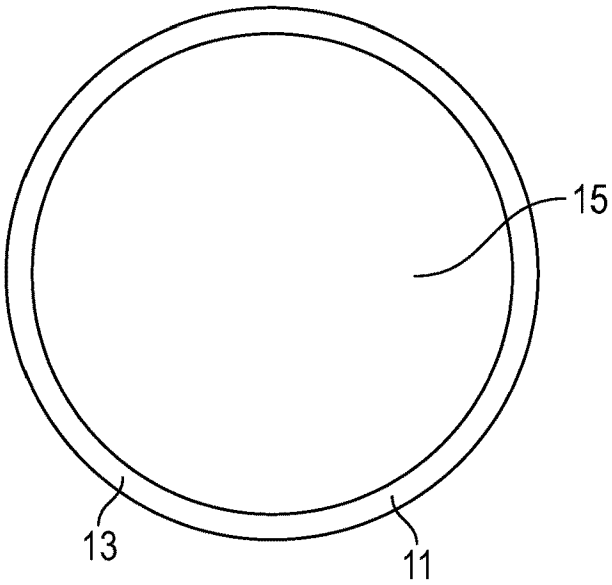
Figure 1B:
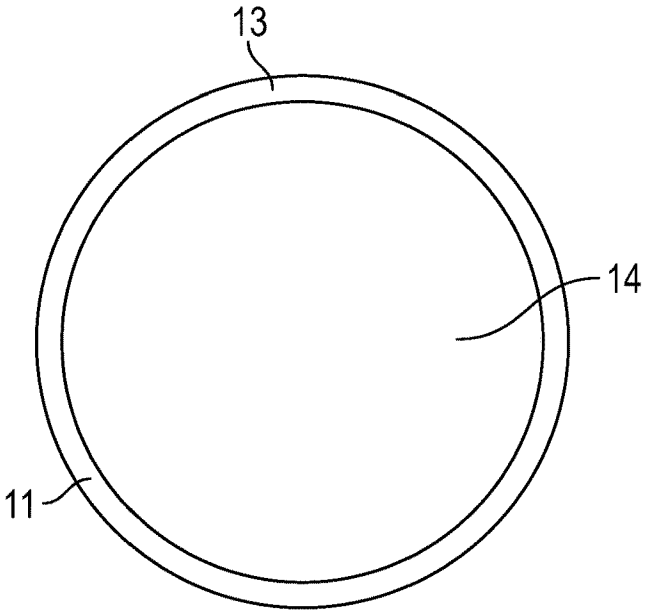
Figure 1A:
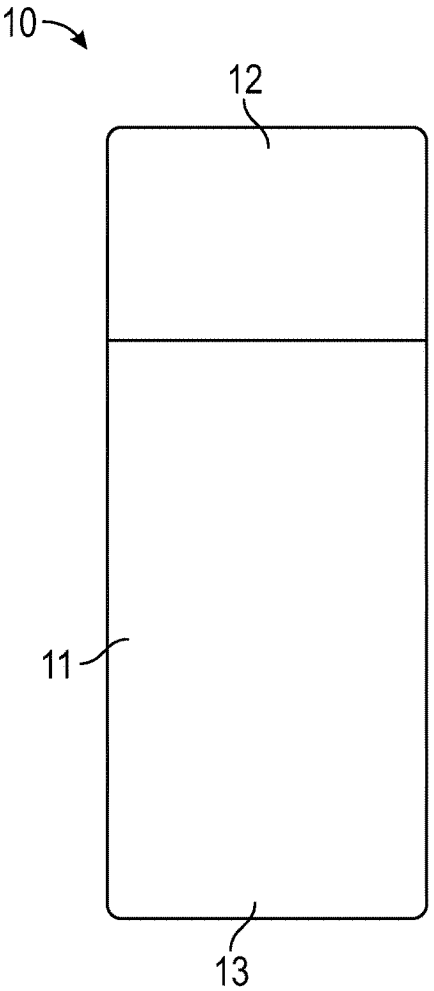

Referring to FIGS. 1*a-c,* 2 and 3, a cylindrical transfer tube 10 comprises a body 11 having outer side wall 13 and outer cap 12. The outer cap has a top end wall 15 and the tube body has bottom end wall 14. FIG. 1*a* shows a side view of the tube with upper cap fitted, FIG. 1*b* shows a view from below and FIG. 1*c* shows a view from above.

Figure 2:
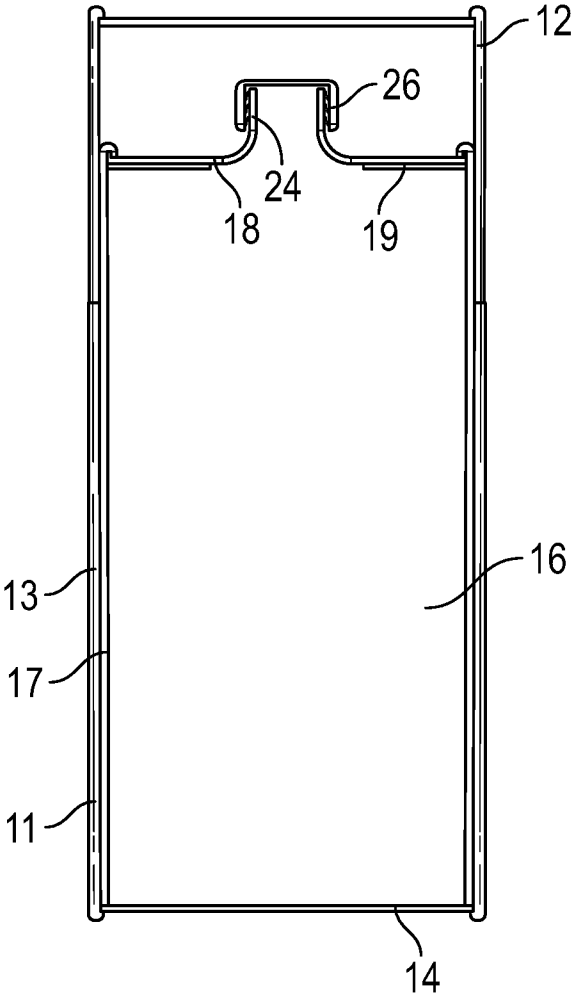
FIG. 2 shows a side view in cross section of the transfer tube.

FIG. 2 shows the tube in cross section, with upper cap fitted. Cavity 16 of the tube is bounded by interior side wall 17, bottom end wall 14 and cavity top wall 18. All walls are of stiff cardboard as is conventional in relation to the known scatter tubes. An upper, interior portion of the cavity top wall is supported by reinforcing ring 19.

Figure 3:
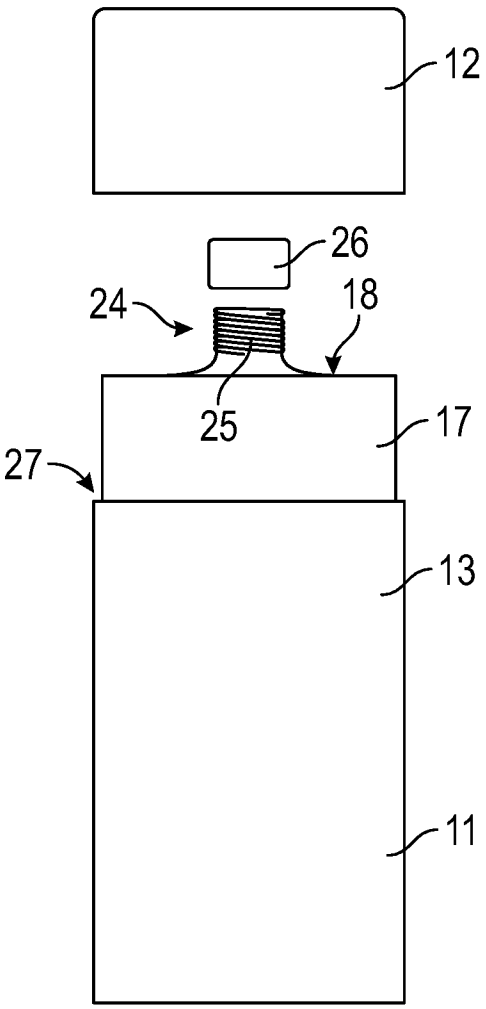
FIG. 3 shows a side view of the transfer tube, expanded to shows the tube body, screw cap and upper cap separated.

Located on upper cavity wall 18, nozzle 24 is formed by a portion of the upper wall being drawn into and extending into a narrowed tube-like exit, continuous with the upper wall and having a screw thread 25 on its exterior circumference. In FIG. 2 the nozzle screw cap 26 is screwed onto the nozzle 24 and the thread is not visible. The thread is visible in FIGS. 3 and 4. Both nozzle and cap are of corn-starch-based polymer and biodegradable. The smooth interior contour of the nozzle, formed from the cavity top wall means there are no internal voids or baffles or pockets, and hence when inverted ashes are not trapped internally and the whole of the cavity can be emptied of ashes, leaving none behind.

Outer cap 12 slides onto the upper portion of the tube, formed by the interior side wall 17 extending upwards and beyond outer side wall 13, forming a shoulder 27 where the outer side wall ends. The cap hence slides downwards as far as the shoulder, forming when in that position a completed, closed transfer tube having a substantially cylindrical appearance. With the outer cap fitted, the screw cap 26 is obscured.

Figure 4:
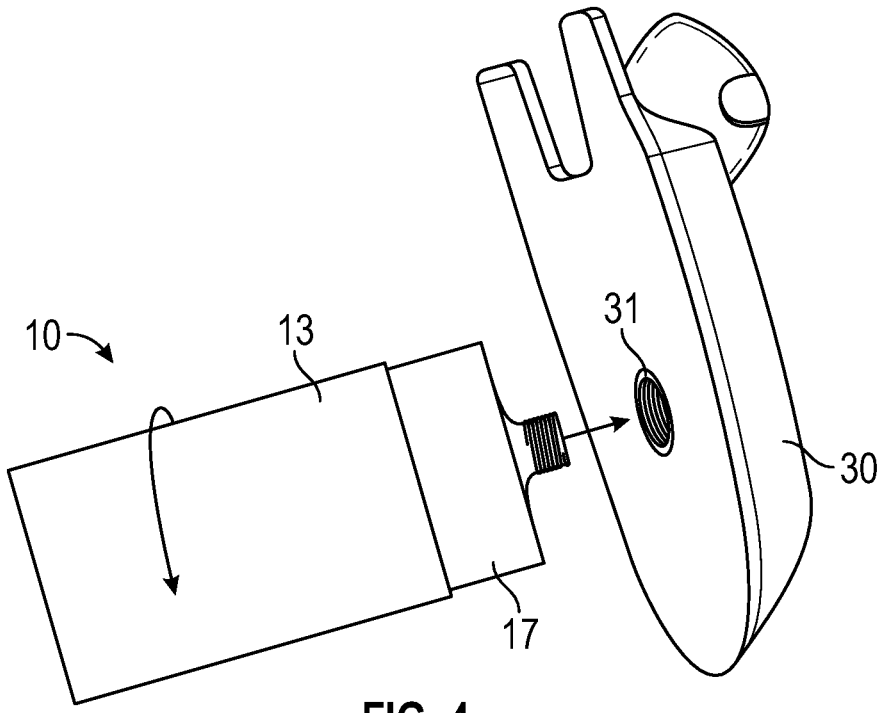
FIG. 4 shows a side view of the tube being inserted into an urn.
Figure 5:
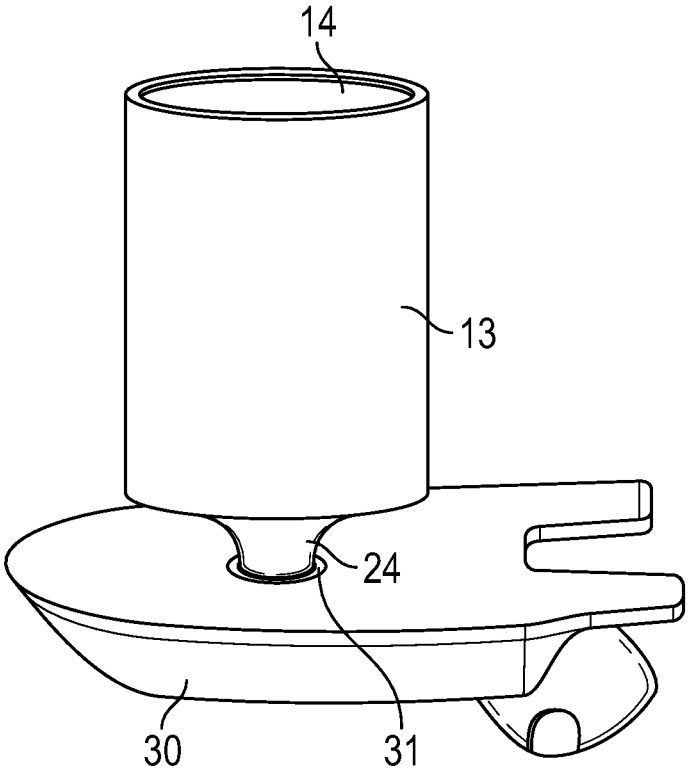
FIG. 5 shows a side view of the tube attached to an urn during transfer of ashes into the urn.

Referring to FIGS. 4 and 5, the transfer tube is shown after being filled with ashes and sealed by its cap, and then the tube containing ashes has now been opened, in that the cap 26 has been removed. It is shown in FIG. 4 being screwed into threaded inlet 31 on cat-shaped urn 30. It is further shown in FIG. 5 in sealed engagement with the urn and inverted so that ashes may transfer into the urn while being invisible to observers and without leakage.

Figure 6:
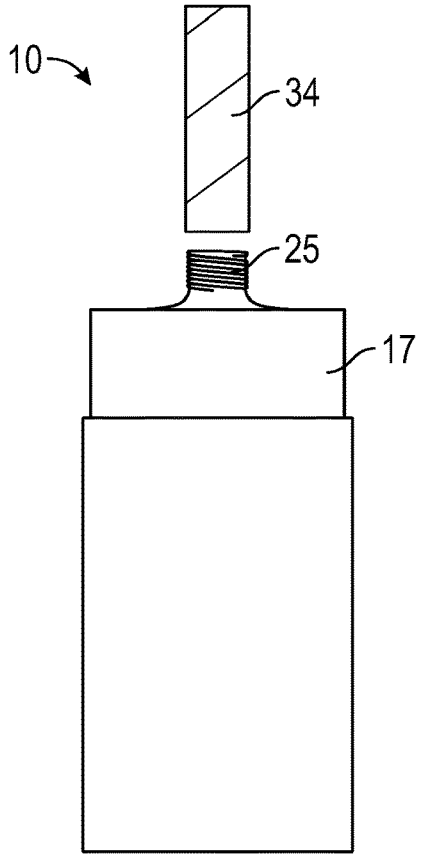
FIG. 6 shows a side view of the tube with a nozzle extension, expanded to show both separately.
Figure 7:
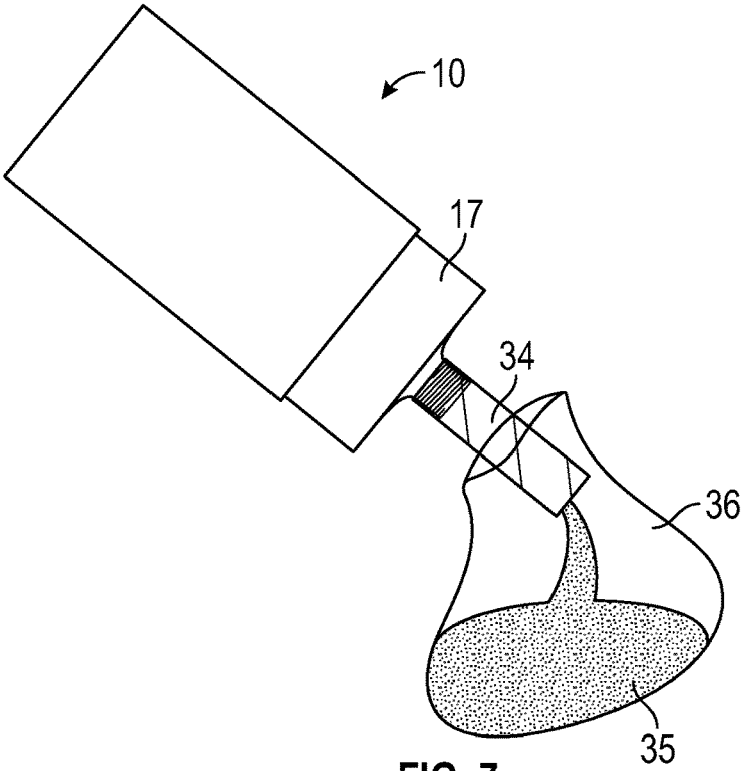
FIG. 7 shows a side view of the tube with nozzle extension attached and transferring ashes into a bag.

Referring to FIGS. 6 and 7, the tube is shown with nozzle extension 34 having an internal screw thread (not shown) at its proximal end, expanded to show both items in FIG. 6 but in FIG. 7 with the extension screwed onto threaded portion 25 of the nozzle 24 and inverted while transferring ashes 35 into bag 36. Use of the extension enables transfer without sight of ashes as the space between the tube and the bag neck is straddled by the extension tube, and with reduced spillage as the tube penetrates deep into the bag neck even though the extension does not fit tightly into any corresponding fitting on the bag (or other receptacle).

The invention thus provides a transfer container for transfer of cremation ashes after cremation, first to receive ashes after cremation into the transfer container and then for transfer from the transfer container into a desired end storage container, e.g. urn or the like, together with methods of using the same and kits comprising the same.

LIST OF PARTS

10 transfer tube
11 body
12 outer cap
13 outer side wall
14 bottom end wall
15 top end wall of outer cap
16 cavity
17 interior side wall
18 cavity top wall
19 reinforcing ring
24 nozzle
25 nozzle thread
26 nozzle screw cap
27 shoulder
30 urn
31 urn inlet
34 nozzle extension
35 ash
36 bag

What is claimed is:

1. A method of transferring cremation ashes into a long term ashes storage container, comprising:— a. providing the ashes from a cremation, b. providing the long term ashes storage container having an inlet and providing a crematorium ashes transfer container that comprises a nozzle capable of sealing engagement with the inlet on the long term storage container, wherein the crematorium ashes transfer container is made of paper and/or cardboard, c. transferring the ashes into the crematorium ashes transfer container via the nozzle, d. sealing the crematorium ashes transfer container with the ashes inside, e. opening the nozzle, f. connecting the nozzle with the inlet of the long term storage container so as to be in sealing engagement therewith, and g. transferring the ashes into the long term storage container.

2. The method of claim 1, comprising transferring the ashes into the long term storage container without the ashes being visible or leaking during transfer.

3. The method of claim 1, wherein the nozzle has a screw thread and the inlet has a screw thread and the method comprises screwing the nozzle into or onto the inlet so as to form a seal therewith prior to transferring the ashes.

4. The method of claim 1, wherein the crematorium ashes transfer container comprises one or more sides and/or walls defining a cavity to receive the ashes, and an outlet in one of the sides and/or walls allowing exit of the ashes in the cavity from the container, the outlet comprising the nozzle and a removeable cap that closes the nozzle; and wherein when in said sealing engagement, the ashes within the cavity of the container can be transferred to the long term storage container without being visible during transfer and without leakage of the ashes during transfer.

5. A crematorium ashes transfer container for storage of ashes from a crematorium and for subsequent transfer of the ashes into a separate, long term storage container, wherein the transfer container is made of paper and/or cardboard and comprises: one or more sides and/or walls defining a cavity to receive the ashes; and an outlet in one of the sides and/or walls allowing exit of the ashes in the cavity from the container, the outlet comprising a nozzle and a removeable cap that closes the nozzle, the nozzle being capable of sealing engagement with the long term storage container, whereby when in said sealing engagement, the ashes within the cavity of the container can be transferred to the long term storage container without being visible during transfer and without leakage of the ashes during transfer; and wherein the outlet is located on an upper surface of the container, a region of the one or more sides and/or walls around the circumference of the container at the top of the container is slightly reduced in circumference compared with the circumference of the side wall below that region, and the container further comprises an outer cap in the form of an open ended sheath that is of similar cross section to the side wall below that region and fits around the region of reduced circumference so as to obscure the outlet and its cap.

6. The crematorium ashes transfer container of claim 5, wherein the one or more sides and/or walls are in the form of a tube.

7. The crematorium ashes transfer container of claim 5, wherein the container is substantially circular or rectangular in cross section.

8. The crematorium ashes transfer container of claim 7, made entirely of biodegradable components.

9. The crematorium ashes transfer container of claim 7, wherein the container can only be filled via the nozzle.

10. The crematorium ashes transfer container of claim 5, wherein the cavity has an interior profile such that once opened there are no interior nooks or crannies or crevices that can trap ash and prevent complete emptying of ash from the container during transfer.

11. The crematorium ashes transfer container of claim 5, wherein the nozzle seals to a corresponding fitting on the long term ashes storage container.

12. The crematorium ashes transfer container of claim 5, wherein the nozzle has a screw thread and is sealable with a screw cap, for use with the long term storage container having an inlet with a screw threaded fitting.

13. A kit comprising a crematorium ashes transfer container for storage of ashes from a cremation and for subsequent transfer of the ashes into a separate, sealable, long term storage container;

the transfer container made of paper and/or cardboard and comprising one or more sides and/or walls defining a cavity to receive the ashes, and an outlet in one of the sides and/or walls allowing exit of the ashes in the cavity from the container, the outlet comprising a nozzle and a removeable cap that closes the nozzle;

the long term ashes storage container comprising a cavity and an inlet for transfer of the ashes into the cavity, wherein the nozzle on the transfer container can sealingly engage with the inlet on the storage container, or the nozzle of the transfer container can sealingly engage with a nozzle extension having a distal end and a proximal end, wherein the nozzle on the transfer container can sealingly engage with the proximal end of the nozzle extension; and wherein when in said sealing engagement, the ashes within the cavity of the container can be transferred to the long term storage container without being visible during transfer and without leakage of the ashes during transfer.

14. A method of handling ashes comprising:

a. providing ashes from a cremation, b. providing a crematorium ashes transfer container that comprises a sealable nozzle capable of sealing engagement with an inlet on a long term storage container, c. transferring the ashes into the crematorium ashes transfer container via the nozzle, and d. sealing the crematorium ashes transfer container with the ashes inside, wherein the crematorium ashes transfer container comprises one or more sides and/or walls defining a cavity to receive the ashes, and an outlet in one of the sides and/or walls allowing exit of the ashes in the cavity from the container, the outlet comprising the nozzle and a removeable cap that closes the nozzle, wherein when in said sealing engagement, the ashes within the cavity of the container can be transferred to the long term storage container without being visible during transfer and without leakage of the ashes during transfer.

* * * * *